United States Patent [19]

Leonard et al.

[11] Patent Number: 4,986,766

[45] Date of Patent: Jan. 22, 1991

[54] ELECTRICAL CONNECTOR HAVING ANTI-OVERSTRESS LATCH

[75] Inventors: Russell J. Leonard, Downers Grove; Michael J. Miskin, Naperville, both of Ill.; Ross E. Schroll, East Rochester, N.Y.

[73] Assignee: Molex Incorporated, Lisle, Ill.

[21] Appl. No.: 399,048

[22] Filed: Aug. 28, 1989

Related U.S. Application Data

[63] Continuation of Ser. No. 232,985, Aug. 17, 1988, abandoned.

[51] Int. Cl.[5] ..... H01R 13/627

[52] U.S. Cl. ..... 439/352; 439/357

[58] Field of Search ..... 439/350, 353, 354, 357

[56] References Cited

U.S. PATENT DOCUMENTS 4,710,135 12/1987 Aoyama et al. ..... 439/354

4,801,275 1/1989 Ikeda et al. ..... 439/357 X

FOREIGN PATENT DOCUMENTS 55-49433 3/1980 Japan ..... 439/352

*Primary Examiner*—Eugene F. Desmond

*Attorney, Agent, or Firm*—Louis A. Hecht; Stephen Z. Weiss; Charles S. Cohen

[57] ABSTRACT

An electrical connector housing with a latch structure is provided. The latch is releasably engageable with corresponding structure on a mateable electrical connector housing. The latch structure resiliently and deflectably extends from the electrical connector housing. At least one rib extends from the surface of the electrical connector housing adjacent the deflectable end of the latch structure to prevent fishhooking of cables or the like into the space between the latch structure and the housing. The rib for preventing such fishhooking is further engageable with the latch structure to prevent overstress. Side walls disposed in spaced relationship to the latch structure may further prevent overstress and fishhooking.

26 Claims, 6 Drawing Sheets

ELECTRICAL CONNECTOR HAVING ANTI-OVERSTRESS LATCH

This application is a continuation of application Ser. No. 232,985, filed Aug. 17, 1988, now abandoned.

BACKGROUND OF THE INVENTION

Many electrical connectors include latch means for securely but releasably retaining a pair of electrical connector housings in a mated condition. More particularly, these prior art connectors include mateable pairs of molded plastic housings, each of which is constructed to receive a plurality of terminals therein. The terminals of one housing electrically contact the terminals of the other housing when the housings are in their mated condition.

Unitarily molded electrical connector housings are generally considered desirable in that they yield certain manufacturing efficiencies, simplify the installation and use of the connector and minimize inventory management problems. Thus, it is often desirable to unitarily mold an entire electrical connector housing, including the latch means thereof.

Many electrical connectors are used in environments where they will be repeatedly connected and disconnected by personnel having relatively little familiarity with the mechanics and intended use of the connector. For example, electrical connectors often are employed in photostatic copiers and other office equipment that may periodically be serviced by field technicians or by the office staff that uses the copier or other such business machine. Field technicians often are not adequately trained on the proper usage of every electrical connector they are likely to encounter. Office personnel using various business machines typically have even less training and familiarity with the electrical connectors they may periodically be required to connect and/or disconnect. This lack of familiarity with the electrical connectors manipulated by field or office personnel can result in overstressing the latch mechanisms employed to lockingly but releasably retain electrical connector housings in a mated condition. For example, inexperienced field personnel may unintentionally bias a latch mechanism too far, thereby breaking or reducing the effectiveness of the latch.

Electrical connector housings have been developed to minimize this potential for overstressing the latch structures thereof. For example, U.S. Pat. No. 4,462,654 which issued to Aiello on July 31, 1984 shows a latch integrally and pivotally connected to a housing. The forward end of the latch extends from the pivoted connection to define a latch portion which is engageable with corresponding structure on a mateable housing. The rearward end of the latch member extends in the opposite direction from the pivot and includes an overstress stop which is pivotable into a lug or wall on the electrical connector housing. Contact between the overstress stop and the lug or wall of the electrical connector housing is intended to limit the amount of rotation around the pivot point during the normal engagement of the electrical connector housings. Although this construction may control the amount of pivoting during proper use of the electrical connector, it provides no positive anti-stress protection adjacent the forward end of the latch member. Thus, field personnel inexperienced with the intended operation of the latch shown in U.S. Pat. No. 4,462,654 could apply rotatable pressure to the forwardmost end of the latches for either locking or releasing the electrical connector housings to one another. Such rotational forces exerted on the forward end of the latch member could overstress the latch, thereby causing the latch to break or be of reduced effectiveness.

Another problem that can be encountered when inexperienced field personnel employ electrical connectors is referred to by persons skilled in this art as "fish-hooking". In particular, the latch members on many electrical connectors are cantilevered structures that effectively function as fishhooks which may catch insulated leads as the electrical connector is being inserted into or removed from an electrical apparatus. Fishhooking can damage an adjacent circuit that is unintentionally caught by the latch structure of the electrical connector housing. Additionally, an attempt to operate the latch structure while a wire or other lead is in its fishhooked engagement can permanently damage the latch.

Several electrical connector housings have been manufactured to avoid such fishhooking problems. For example, U.S. Pat. No. 4,272,145 which issued to LaDuke on June 9, 1981 includes a guard plate disposed in proximity to a lever arm to prevent unintentional fishhooking of wires that may be disposed in proximity to the electrical connector housing. The electrical connector housing shown in U.S. Pat. No. 4,272,145 provides no anti-overstress protection, and the anti-overstress protection shown in the above-described U.S. Pat. No. 4,462,654 could not readily be incorporated into the design of U.S. Pat. No. 4,272,145.

Other electrical connectors with integral latch structures therein are shown in U.S. Pat. No. 4,582,378 which issued to Fruchard on Apr. 15, 1986; U.S. Pat. No. 4,640,566 which issued to Matsusaka on Feb. 3, 1987; U.S. Pat. No. 4,105,275 which issued to Dickson et al. on Aug. 8, 1978; and U.S. Pat. No. 3,179,738 which issued to DeLyon on Apr. 20, 1965.

In view of the above, it is an object of the subject invention to provide an electrical connector housing constructed to positively prevent overstress of the latch structure thereof.

Another object of the subject invention is to provide an electrical connector housing that positively prevents the latch structures from being entangled with insulated conductive leads employed in the vicinity of the connector.

An additional object of the subject invention is to provide an electrical connector housing of simple integrally molded construction which prevents overstress of the latch structures thereof and which prevents fishhooking of insulated conductive leads.

A further object of the subject invention is to provide an electrical connector housing that cannot be damaged during initial harness work, handling or subsequent use.

SUMMARY OF THE INVENTION

The subject invention is directed to an electrical connector having a nonconductive housing. The housing may be unitarily molded from a plastic material and comprises a plurality of recesses or cavities for receiving electrical terminals therein. The nonconductive housing of the electrical connector comprises a latch structure deflectably extending therefrom. The latch structure may comprise a ramped locking means disposed to engage corresponding structure on a mateable electrical connector housing. Thus, in this embodiment, sliding contact between the ramped locking means and the opposed mateable electrical connector housing will cause the latch structure to deflect. However, the deflectable latch structure will resiliently return to its initial undeflected condition, such that the locking means thereof may engage corresponding structure on the opposed mateable electrical connector housing. The latch structure may comprise release actuator means for manually and/or mechanically deflecting the latch structure to facilitate release of the locking means from the opposed mateable electrical connector housing, and thereby enabling disconnection of the two electrical connectors.

To prevent fishhooking of insulated conductive leads, the electrical connector housing of the subject invention comprises at least one rib disposed in proximity to the deflectable latch structure. More particularly, the anti-fishhook rib extends from the electrical connector housing at a location thereon generally adjacent an end of the latch structure which could otherwise fishhook an adjacent lead. The rib for preventing the latch structure from fishhooking adjacent insulated conductive leads may be unitarily molded with the electrical conductor housing. The housing may comprise a pair of ribs disposed on opposite sides of the latch structure for positively preventing fishhooking of insulated conductive leads by the latch structure.

The electrical connector housing of the subject invention further comprises means for preventing overstressing of the latch structure. More particularly, the anti-overstressing means preferably is disposed at the end of the latch structure which would undergo the greatest deflection during the mating and unmating of the electrical connector. The anti-overstress means may be disposed in spaced relationship to a surface of the electrical connector housing toward which the latch structure is deflectable for positively limiting the amount of deflection of the latch structure away from adjacent surfaces of the electrical connector housing. The anti-overstress means may be unitarily molded with the electrical connector housing. Additionally, the anti-overstress means may extend unitarily from the rib for preventing fishhooking.

In one embodiment, the anti-overstress means may extend unitarily from an anti-fishhook rib in generally spaced relationship to a cantilevered latch structure, such that the free end of the cantilevered latch structure is disposed intermediate the anti-overstress means and the adjacent surface of the electrical connector housing. In this embodiment, the latch structure is deflectable between adjacent parts of the electrical connector housing and the anti-overstress means. The anti-overstress means, therefore, positively prevents over-deflection of the latch structure away from the electrical connector housing.

In certain embodiments, a pair of anti-fishhooking ribs are provided, with each anti-fishhooking rib comprising an anti-overstress arm extending unitarily therefrom for limiting the amount of deflection of the latch structure relative to other portions of the electrical connector. In still other embodiments, the anti-overstress means may extend unitarily between a pair of spaced apart anti-fishhooking ribs to effectively define a bridge which limits the deflection of the latch structure. In these embodiments, the anti-overstress means will be disposed generally at a location of maximum deflection of the cantilevered latch structure.

In other embodiments the anti-overstress means may be integral with the latch structure. In these embodiments, the latch structure is not cantilevered, but rather is supported at opposed ends, and is resiliently deflectable intermediate the opposed ends. Thus, the locking protrusion or other such releaseable locking means may be disposed at a location along the latch structure intermediate the opposed supports thereof. Additionally, in these embodiments, the supports of the latch structure at one or both ends simultaneously perform both an anti-overstress function and a anti-fishhooking function.

DETAILED DESCRIPTION OF THE PREFERRED EMBODIMENTS

Figure 1:
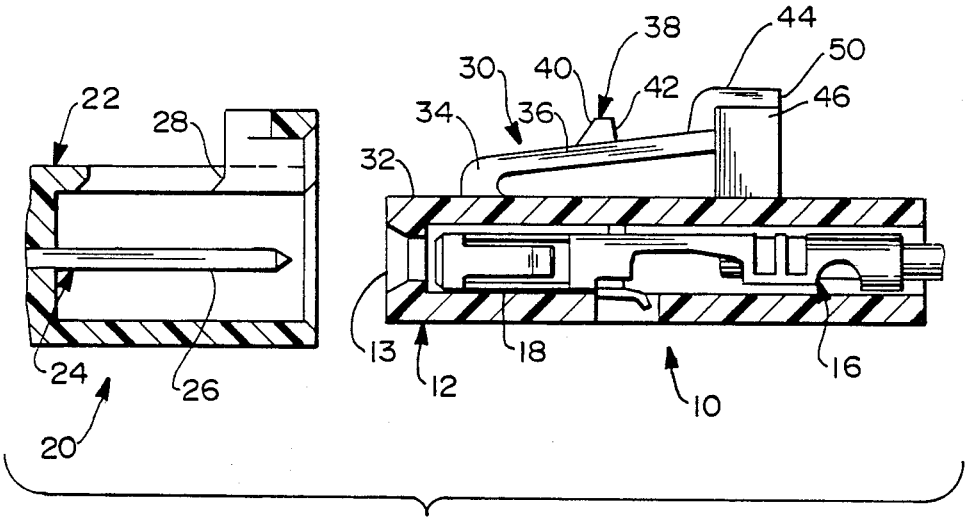
FIG. 1 is a cross-sectional view of a pair of mateable electrical connectors in accordance with the subject invention.

An electrical connector in accordance with the subject invention is identified generally by the numeral 10 in FIG. 1. The electrical connector 10 comprises a unitarily molded plastic housing 12 having a forward mating end 13 and a plurality of cavities 14 with conductive terminals 16 securely mounted therein. The terminals 16 each comprise a conductor engaging end (not shown) for making electrical contact with a conductive lead, such as an individually insulated wire, a ribbon cable or the like. The conductor engaging end of the terminal 16 may comprise insulation displacement means or crimp means for engaging the conductive lead. The terminal 14 further comprises a mating end 18, which, as depicted in FIG. 1, defines a female pin receiving contact structure. The terminal 16 typically will be part of a DC signal line, with the connector 10 being used, for example, in a photostatic copier or other such business machine.

The electrical connector 10 defines a male connector which is mateable with a female connector indicated generally by the numeral 20 in FIG. 1. The female connector 20 comprises a nonconductive housing 22 and a plurality of pin terminals 24 securely mounted therein. Each pin terminal 24 comprises a conductor engaging end (not shown) and an opposed mating end 26. The mating end 26 of the pin terminals 24 are engageable in the pin receiving contact structure at the mating end 18 of terminals 16 in the electrical connector 10.

The nonconductive housing 22 of the female electrical connector 20 is formed with a locking aperture 28 extending entirely therethrough. The locking aperture 28 of the electrical connector 20 is engageable with a deflectable latch structure 30 on the electrical connector 10 as shown in both FIGS. 1 and 2. More particularly, the latch structure 30 is molded unitarily with the nonconductive housing 12 and extends unitarily from the generally planar surface 32 of the nonconductive housing 12. In particular, the latch structure 30 comprises a base 34 which extends unitarily from the surface 32 of the nonconductive housing 12. A deflectable arm 36 extends from the base 34 in spaced relationship to the surface 32 of the nonconductive housing 12 and generally away from the mating end 13 of the housing 12.

A locking protrusion 38 extends from the deflectable arm portion 36 of the latch structure 30 from the side thereof opposite surface 32 of the housing 12. The locking protrusion 38 comprises a ramped forward surface 40 and a rearward locking surface 42 which is aligned generally orthogonal to the surface 32 of the housing 12. The rearward locking surface 42 is disposed along the connector 10 at a location to engage the locking aperture 28 in the housing 22 of electrical connector 20 show in FIG. 1. More particularly, the mateable housings 12 and 22 are dimensioned such that the ramped forward surface 40 of the locking protrusion 38 on the housing 12 will cammingly engage the housing 22 during the forwardly directed mateable insertion of the housing 12 into the housing 22. The camming engagement of the forward ramped surface 40 with the opposed surface on the housing 22 will cause the latch structure 30 to deflect toward surface 32, and thereby permit continued insertion of the housing 12 into the housing 22. However, upon sufficient insertion of the housing 12 into the female housing 22, the locking protrusion 38 will align with the locking aperture 28 to permit the latch structure 30 to resiliently return to its unbiased condition. Thus, the rearward locking surface 42 of the protrusion 38 will engage the locking aperture 28 of housing 22 to lockingly but releaseably hold the electrical connectors 10 and 20 in their mated condition.

The latch structure 30 further comprises a depressible actuator 44 on generally the same side of the latch structure 30 as the locking protrusion 38 and at a location along the latch structure 30 remote from the base 34. In particular, the locking protrusion 38 is disposed intermediate the base 34 of latch structure 30 and the depressible release actuator 44 thereof. The depressible release actuator 44 substantially corresponds to a location of maximum deflectability along the latch structure 30 in the embodiment of the housing 12 depicted in FIGS. 1 and 2. As a result of this construction, a force exerted on the depressible release actuator 44 to urge the latch structure toward the surface 32 of the housing 12 will disengage the locking protrusion 38 from the locking aperture 28 in the female housing 22.

Figure 2:
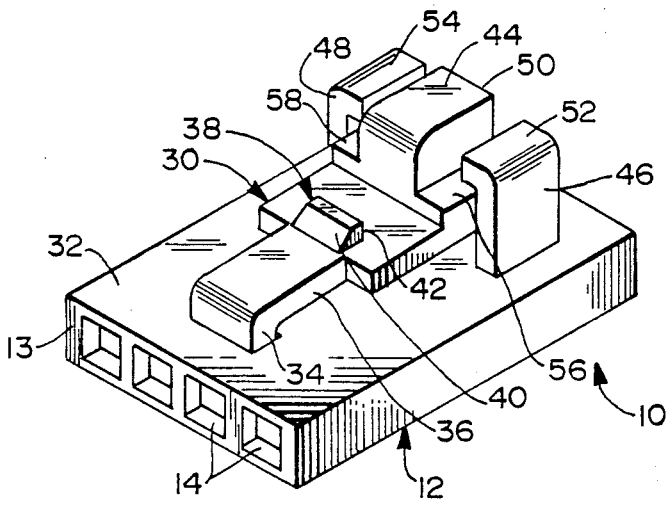
FIG. 2 is a perspective view of an electrical connector in accordance with the subject invention.

The housing 12 depicted in FIGS. 1 and 2 further comprises a pair of anti-fishhook ribs 46 and 48 which are disposed respectively on opposite sides of the latch structure 30 and slightly spaced therefrom. More particularly, the ribs 46 and 48 are disposed to be generally in line with the end 50 of the latch structure 30 remote from the base 34 thereof. As a result of this construction, the ribs 46 and 48 positively prevent the latch structure 30 from fishhooking or otherwise unintentionally engaging wire leads or such that may be employed in proximity to the electrical connector 10. In particular, the ribs 46 and 48 prevent a wire lead or the like from being unintentionally engaged intermediate the latch structure 30 and the surface 32 of housing 12, thereby ensuring that deflectability of the latch structure 30 toward the surface 32 to lockingly engage the connector 10 within the connector 20.

The anti-fishhooking ribs 46 and 48 are provided with anti-overstress arms 52 and 54 which extend from the respective ends of the ribs 46 and 48 remote from the surface 32. The arms 52 and 54 extend toward one another a sufficient distance to align with portions of the latch structure 30. Specifically, as illustrated most clearly in FIG. 2, the latch structure 30 is provided with ledges 56 and 58 disposed on the longitudinal sides thereof generally adjacent the anti-overstress arms 52 and 54 respectively. The ledges 56 and 58 are disposed in generally adjacent or slightly spaced relationship to the anti-overstress arms 52 and 54 in the undeflected condition of the latch structure 30. Thus, the anti-overstress arms 52 and 54 will not interact with the latch structure 30 during the normal engagement and disengagement of the housing 12 with the female housing 22. However, the anti-overstress arms 52 and 54 extending unitarily from the anti-fishhooking ribs 46 and 48 will positively prevent overstressing the latch structure 30. In particular, any attempt by a technician to urge the latch structure 30 away from the surface 32 will be positively limited by engagement of the anti-overstress arms 52 and 54 with the ledges 56 and 58 of the latch structure 30.

Figure 3:
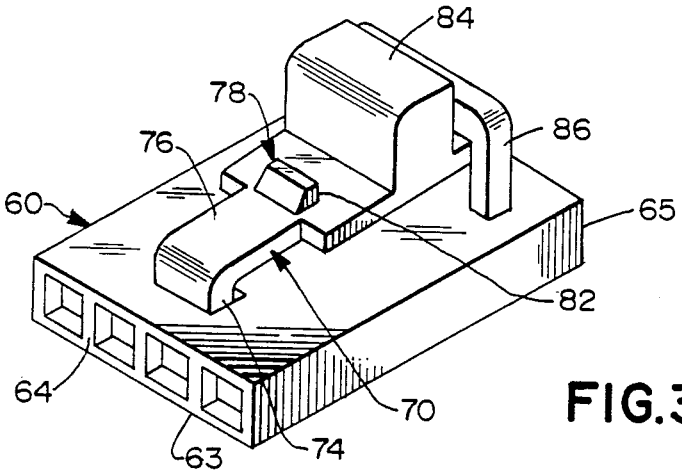
FIG. 3 is a perspective view showing the mating end of a second embodiment of an electrical connector in accordance with the subject invention.
Figure 4:
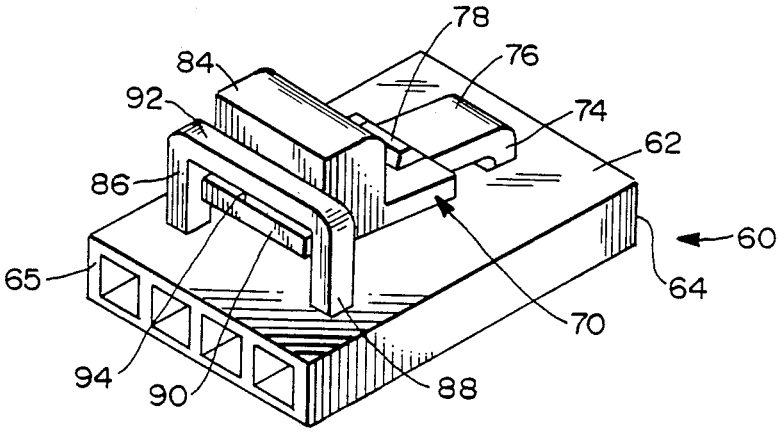
FIG. 4 is a perspective view showing the conductor receiving end of the electrical connector shown in FIG. 3.

A second embodiment of the electrical connector housing of the subject invention is identified generally by the numeral 60 in FIGS. 3 and 4. In particular, the housing 60 comprises a surface 62 extending generally orthogonal to the mating end 63 thereof. A plurality of terminal receiving cavities 64 extend from the mating end of the housing 60 to the conductor receiving end 65 thereof. A latch structure 70 is deflectably cantilevered from the surface 62 of housing 60 and is unitary therewith. In particular, the latch structure 70 comprises a base 74 generally adjacent the mating end 63 of the housing 60. A deflectable arm 76 extends from the base 74 and includes a locking protrusion 78 on the side thereof generally opposite the surface 62. The locking protrusion 78 includes a ramped forward surface 80 and a locking rear surface 82 which is aligned generally orthogonal to the surface 62 of housing 60. A depressible release actuator 84 is disposed at a location along the latch structure 70 remote from the base 74 thereof, such that the locking protrusion 78 is intermediate the base 74 and the depressible release actuator 84. Thus, a force exerted on the depressible release actuator 84 will deflect the latch structure 70 toward the surface 62 of housing 60.

The housing 60 further comprises a pair of anti-fishhook arms 86 and 88 which are molded unitarily with the housing 60 to extend generally orthogonal to the surface 62 at a location generally in line with the rear end 9 of the latch structure 70. As described with the previous embodiment, the anti-fishhook arms 86 and 88 positively prevent a conductive lead from being engaged or fishhooked by the latch structure 70. The housing 60 further comprises an anti-overstress bar 92 extending unitarily between the anti-fishhook ribs 86 and 88. The anti-overstress bar 92 is disposed at a location to engage the latch structure 70 for preventing excessive deflection or overstress of the latch structure 70 away from the surface 62 of the housing 60. In particular, the latch structure 70 is provided with a ledge 94 at the end 90 thereof. The ledge 94 is disposed to engage the anti-overstress bar 92 to thereby prevent any excessive deflection of the latch structure 70 away from the surface 62.

Figure 5:
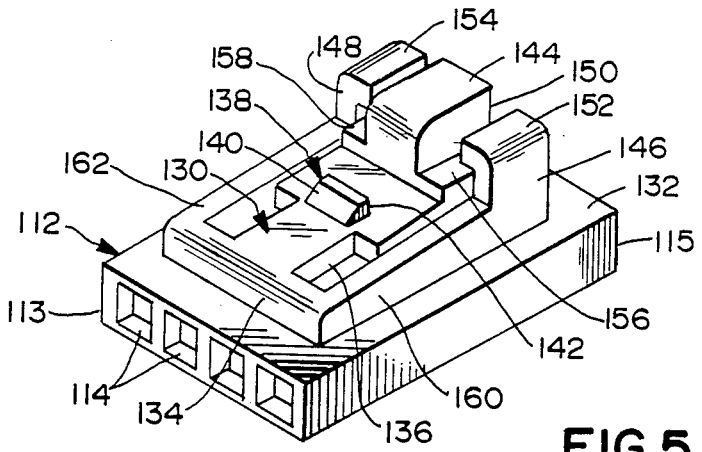
FIG. 5 is a perspective view showing the mating end of a third embodiment of an electrical connector in accordance with the subject invention.

A third embodiment of the electrical connector housing of the subject invention is illustrated in FIG. 5 and is identified generally by the numeral 112. The housing 112 depicted in FIG. 5 is structurally and functionally similar to the nonconductive housing 12 depicted in FIGS. 1 and 2. More particularly, the housing 112 comprises a mating end 113 with a plurality of cavities 114 extending therein. The cavities 114 extend from the mating end 113 to the opposed connector engaging end 115 and are provided with electrical terminals (not shown) securely mounted therein. To employ similar numbering of the respective embodiments depicted in FIGS. 2 and 5, the latch structure shown in FIG. 5 has been identified generally by the numeral 130. More particularly, the latch structure 130 is deflectably cantilevered from the surface 132 at base 134. The latch structure 130 further comprises a deflectable arm portion 136 with a locking protrusion 138 having a ramped forward surface 140 and a locking rearward surface 142. A depressible release actuator 144 is disposed on the latch structure 130 at a location remote from the base 134 from which the latch structure 130 is cantilevered. Thus, a downward force on the depressible release actuator 144 will cause the latch 130 to deflect toward the surface 132 to facilitate the disengagement of the housing 112 from a mateable female housing as explained above.

The housing 112 further comprises anti-fishhook ribs 146 and 148 disposed in spaced relationship to the cantilevered deflectable latch structure 130 and on opposite sides thereof. The anti-fishhook ribs 146 and 148 are disposed generally in line with the end 150 of the latch structure 130 to prevent the latch structure 130 from snagging or fishhooking conductive leads used in proximity to the housing 112. Anti-overstress arms 152 and 154 extend toward one another from the ends of the anti-fishhook ribs 146 and 148 respectively. The anti-overstress arms 152 and 154 are disposed to engage ledges 156 and 158 of the latch structure 130 to prevent overdeflection of the latch structure 130 away from the surface 132 of housing 112.

The housing 112 differs from the housing 12 described above in that it is provided with side walls 160 and 162 which extend generally parallel to the latch structure 130 and in spaced relationship thereto. More particularly, the side walls 160 and 162 extend unitarily between the base 134 of the cantilevered latch structure 130 and the anti-fishhook ribs 146 and 148. The side walls 160 and 162 define a height measured from the surface 132 which substantially corresponds to the undeflected height of the cantilevered latch structure 130. Thus, the side walls 160 and 162 provide additional protection to the latch structure 130 and 132 from contact on the respective sides of the latch structure 130. As a result, the housing 112 depicted in FIG. 5 protects the latch structure 130 from overdeflection away from the surface 132 and from overdeflection about an axis extending generally orthogonal to the surface 132. Additionally, the side walls 160 and 162 provide further assurance that adjacent conductive leads or the like will not inadvertently become engaged intermediate the cantilevered latch structure 130 and the surface 132. Thus the side walls 160 and 162 prevent overstress in the latch structure 130 and simultaneously prevent certain types of fishhooking beneath the latch structure 130.

Figure 6:
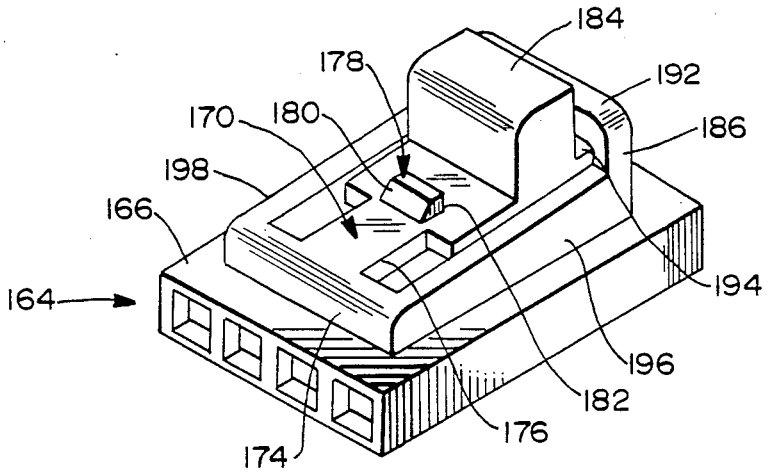
FIG. 6 is a perspective view showing the mating end of a fourth embodiment of an electrical connector in accordance with the subject invention.
Figure 7:
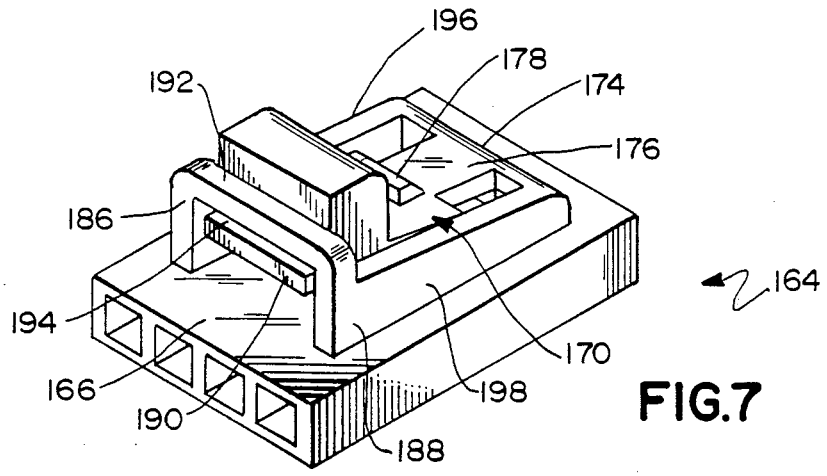
FIG. 7 is a perspective view of the conductor receiving end of the electrical connector depicted in FIG. 6.

A fourth embodiment of the electrical connector housing of the subject invention is illustrated in FIGS. 6 and 7 and is identified generally by the numeral 164. The housing 164 depicted in FIGS. 6 and 7 is similar to the housing 60 depicted in FIGS. 3 and 4. In particular, the housing 164 is provided with a latch structure 170 cantilevered from surface 166 at base 174. Again using similar numbers, the latch structure 170 comprises a deflectable arm portion 176 having a locking protrusion 178 extending from the side thereof opposite the surface 166. The locking protrusion comprises a ramped forward surface 180 and a rearward locking surface 182. A depressible release actuator 184 is disposed at a location along the latch structure 170 remote from the base 174 thereof. Anti-fishhook ribs 186 and 188 extend unitarily from the surface 166 at locations generally in line with the end 190 of the latch structure 170. An anti-overstress bar 192 extends unitarily between the anti-fishhook ribs 186 and 188 and is engageable with a ledge 194 disposed generally adjacent the end 190 of the latch structure 170. In particular, the anti-overstress bar 192 will engage the ledge 194 of the locking structure 170 to prevent overstress of the latch structure 170.

The electrical connector housing 164 depicted in FIGS. 6 and 7 differs from the housing 160 of FIGS. 3 and 4 in that side walls 196 and 198 are provided on the housing 164 in a manner similar to the side walls 160 and 162 shown on the housing 112 of FIG. 5. In particular, the side walls 196 and 198 extend from the respective anti-fishhook ribs 186 and 188 to the base 174 of the latch structure 170. The side walls 196 and 198 extend from the surface 166 of the housing 164 a distance substantially corresponding to the height of the latch structure 170 from surface 166. Thus, the side walls 196 and 198 substantially minimize the possibility of a damaging contact with a side of the latch structure 170. Additionally, any such contact that may occur, for example, on the depressible actuator 184 will cause only a minimal transverse deflection of the latch structure 170. Furthermore, as described with respect to the FIG. 5 embodiment, the side walls substantially prevent leads from being extended into the area between the latch structure 170 and the top surface 166, thereby providing additional anti-fishhook protection to the housing 164, and ensuring that the latch structure 170 will operate under virtually all conditions.

Figure 8:
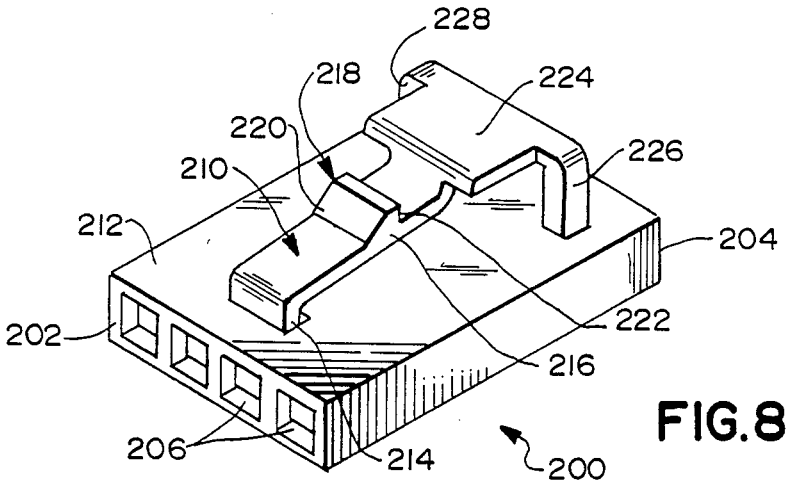
FIG. 8 is a perspective view showing the mating end of a fifth embodiment of an electrical connector in accordance with the subject invention.
Figure 10:
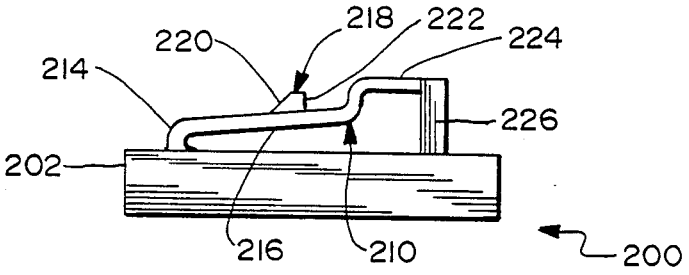
FIG. 10 is a side elevational view of the electrical connector shown in FIGS. 8 and 9.
Figure 9:
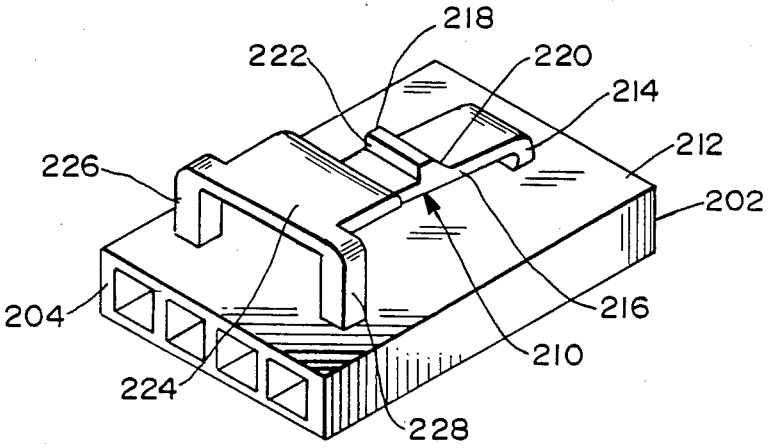
FIG. 9 is a perspective view showing the conductor receiving end of the electrical connector shown in FIG. 8.

A embodiment of the electrical connector housing of the subject invention is illustrated in FIGS. 8–10 and is identified generally by the numeral 200. The electrical connector housing 200 comprises a mating end 202 and an opposed conductor receiving end 204 with a plurality of terminal receiving cavities 206 extending therebetween. The housing 202 further comprises a unitarily molded latch structure 210 which extends from a planar top surface 212. More particularly, the latch structure 210 comprises a base 214 which extends unitarily from the top surface 212. A deflectable arm portion 216 extends from the base 214 generally toward the rear conductor receiving end 204 of the housing 200. The deflectable arm portion 216 of the latch structure 210 is provided with a locking protrusion 218 having a ramped forward surface 220 and a locking rearward surface 222 which is aligned approximately orthogonal to the top surface 212 of the electrical connector housing 200 in the undeflected condition of the latch structure 210.

The latch structure 210 further comprises a depressible release actuator 224 disposed generally at the end of the latch structure 210 remote from the base 214. As shown in FIGS. 8–10 the locking protrusion 218 of the latch structure 210 is disposed intermediate the base 214 thereof and the release actuator 224. By virtue of this construction, a downward pressure on the release actuator 224 toward the surface 212 will deflect the latch structure 210 and enable disengagement of the locking protrusion 218 from a corresponding locking structure on a mateable female connector housing (not shown).

Unlike the previously described embodiments, the deflectable latch structure 210 is not of cantilevered construction. Rather, the electrical connector housing 200 is provided with anti-fishhook ribs 226 and 228 which extend unitarily from the surface 212, and which are unitarily connected to the end of the latch structure 210 remote from the base 214. As a result of this construction, the ribs 226 and 228 simultaneously perform an anti-fishhooking function and an anti-overstressing function. In particular, the ribs 226 and 228 positively prevent any conductive leads or the like from being fish-hooked by the latch structure 210 and trapped between the latch structure 210 and the surface 212 of the housing 200. Furthermore, the ribs 226 and 228 prevent overstress rotation of the latch structure 210 away from the surface 212 of the housing 200. In this manner, overstress damage to the latch structure 210 is prevented.

Figure 11:
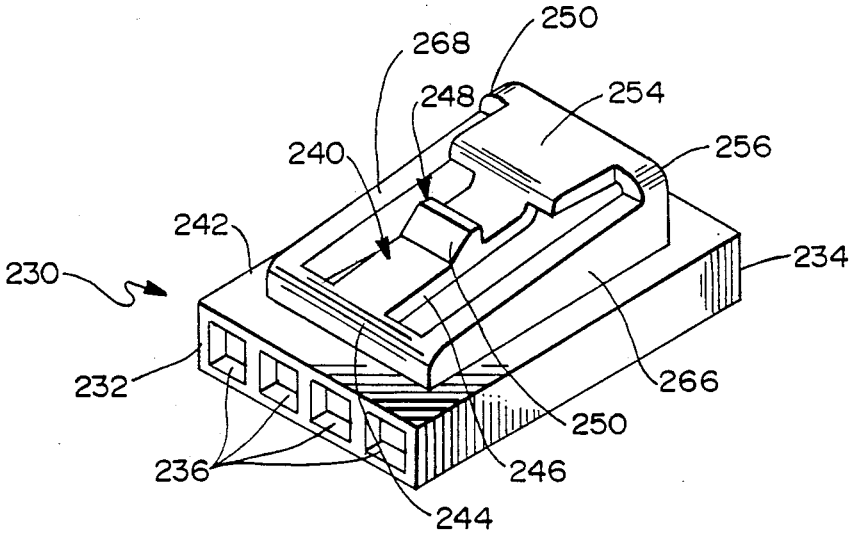
FIG. 11 is a perspective view of the mating end of a sixth embodiment of an electrical connector in accordance with the subject invention.
Figure 12:
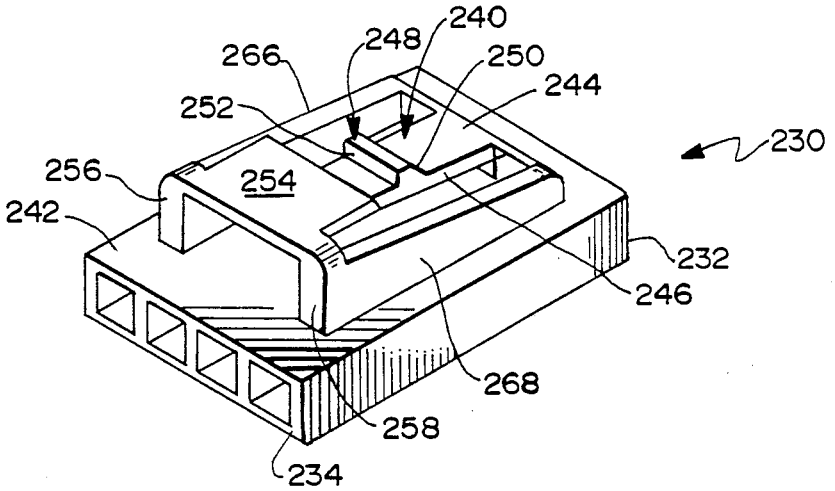
FIG. 12 is a perspective view of the conductor receiving end of the electrical connector shown in FIG. 11.

A variation of the electrical connector housing 200 depicted in FIGS. 8–10 is shown in FIGS. 11 and 12 and is identified generally by the numeral 230. The electrical connector housing 230 comprises a mating end 232 and an opposed conductor receiving end 234. A plurality of terminal receiving recesses 236 extend between the opposed ends 232 and 234 and are provided with electrically conductive terminals securely mounted therein and engageable with a mateable female electrical connector (not shown).

A latch structure 240 extends unitarily from the top surface 242 of the housing 230. More particularly, the latch structure 240 comprises a base 244 which extends unitarily from the top surface 242 of the housing 230. The latch structure 240 further comprises a deflectable arm portion 246 having a locking protrusion 248 extending therefrom. As with the previously described embodiments, the locking protrusion 248 includes a forwardly facing ramp surface 250 and a rearwardly facing locking surface 252. A depressible release actuator 254 is disposed generally at the end of the deflectable latch structure 240 remote from the base 244 thereof. By virtue of this construction, a force exerted on the release actuator 254 and toward the surface 242 of the housing 230 will deflect the latch structure 240 and enable the locking protrusion 248 to disengage from corresponding structure on the female electrical connector (not shown) with which the housing 230 is mateable.

The electrical connector housing 230 further comprises a pair of ribs 256 and 258 which extend unitarily between the top surface 242 of the electrical connector housing 230 and the end of the latch structure 240 remote from the base 244 thereof. Thus, as with the previously described embodiment, the latch structure 240 is not truly cantilevered, but rather is deflectable between the supports at opposed ends thereof. However, as with the previously described embodiment, the ribs 256 and 258 simultaneously prevent fishhooking of conductive leads or the like by the latch structure 240, and also prevent overstress of the latch structure 240 relative to its initial undeflected position as shown in FIGS. 11 and 12.

The electrical connector housing 230 depicted in FIGS. 11 and 12 generally follows the construction of embodiments depicted in FIGS. 5–7. More particularly, the electrical connector housing 230 comprises side walls 266 and 268 which are disposed in spaced generally parallel relationship to the latch structure 240 and on opposite sides thereof. In particular, the side walls 266 and 268 extend unitarily between the respective ribs 256 and 258 and the base 244 of the latch structure 240. The side walls 266 and 268 extend to a height substantially corresponding to the undeflected height of the latch structure 240 from the top surface 242 of the electrical connector housing 230. Thus, as with the embodiments depicted in FIGS. 5–7, the side walls 266 and 268 substantially eliminate the possibility of transverse contact with a side of the latch structure 240 and further minimize the magnitude of any transverse deflection of the latch structure 240. Additionally, the presence of the side walls 266 and 268 adjacent the latch structure 240 substantially prevents any electrical conductor or other circuit component from being engaged intermediate the latch structure 240 and the surface 242 of the electrical connector housing 230.

In summary, an electrical connector housing is provided with a latch structure that positively prevents overstressing and fishhooking. In particular, the electrical connector housing comprises a deflectable latch structure extending from one surface thereof. At least one anti-fishhook rib extends from the electrical connector housing in proximity to the deflectable end of the latch structure. The anti-fishhook rib prevents conductive leads or the like from being engaged intermediate the deflectable latch structure and the opposed facing surface of the electrical connector housing. The anti-fishhook rib is constructed to engage the latch structure and prevent overstress or overdeflection of the latch structure. A pair of such anti-fishhooking ribs and corresponding anti-overstress arms may be provided on opposed respective sides of the latch structure. The electrical connector housing may further comprise side walls disposed in spaced generally parallel relationship to the deflectable latch structure for further preventing overstress and for further preventing the fishhooking of conductive leads or the like into the space between the deflectable latch structure and the opposed facing wall of the electrical connector housing.

I claim:

1. An electrical connector comprising a housing having at least one external surface, a resilient deflectable latch having a base portion on said external surface and a deflectable portion in spaced relationship to said external surface, said deflectable portion being cantilevered relative to said base portion, a pair of anti-fishhook ribs extending from said external surface in spaced relationship to said deflectable portion of said latch and generally adjacent a portion of said latch remote from said base portion, said anti-fishhook ribs inhibiting extraneous materials from hooking onto said latch remote from said base portion, and anti-overstress means extending from at least one of said anti-fishhook ribs for limiting deflection of said deflectable portion of said latch relative to said external surface of said housing.

2. An electrical connector as in claim 1, wherein said portion of said latch remote from said base portion is disposed intermediate said anti-overstress means and said external surface of said housing, such that said deflectable portion of said latch is deflectable relative to said anti-overstress means.

3. An electrical connector as in claim 1 wherein said anti-overstress means extends unitarily between said anti-fishhook ribs.

4. An electrical connector as in claim 3 wherein said anti-overstress means is unitary with said latch and further comprising a pair of side walls extending respectively from said anti-fishhook ribs in generally spaced relationship to said deflectable portion of said latch and on opposed sides thereof.

5. An electrical connector as in claim 1 wherein said arm is disposed in spaced relationship to said latch such that said remote end of said latch is disposed intermediate said arm and said outer surface of said connector housing.

6. An electrical connector as in claim 5 wherein said side walls extend from said external surface of said housing a distance greater than or equal to the distance between said latch and said external surface of said housing.

7. An electrical connector comprising a connector housing having an outer surface, a resilient deflectable latch having a base connecting said latch to said outer surface of said connector housing and having a deflectable portion extending from said base to a remote end that is deflectable relative to said outer surface of said connector housing, said deflectable portion being cantilevered relative to said base, anti-fishhook means extending from said outer surface of said connector housing adjacent said remote end of said latch, said anti-fishhook means inhibiting extraneous materials from interfering with the deflectability of said remote end of said latch relative to said outer surface of said housing and anti-overstress means integral with said anti-fishhook means, said anti-overstress means being disposed adjacent the remote end of said latch so as to limit the deflection of said remote end of said latch relative to said outer surface of said connector housing, and said remote end of said latch being disposed intermediate said anti-overstress means and said outer surface of said connector housing, such that said remote end is deflectable relative to said anti-overstress means.

8. An electrical connector as in claim 7 wherein said anti-fishhook means includes rib means projecting from said outer surface of said housing along the side of said deflectable portion and to at least said remote end of said latch.

9. An electrical connector as in claim 8 wherein said rib means includes a first rib disposed on one side of said deflectable portion and a second rib disposed on an opposite side of said deflectable portion.

10. An electrical connector as in claim 9 wherein said first rib projects generally perpendicularly from said outer surface of said connector housing and said second rib projects generally perpendicularly from said outer surface of said connector housing and wherein said anti-overstress means includes a first arm extending generally perpendicularly from said first rib and a second arm extending generally perpendicularly from said second rib, said first and second arms are disposed relative to said remote end of said latch to limit the deflection of said deflectable portion relative to the outer surface of said connector housing.

11. An electrical connector as in claim 9 wherein said anti-overstress means includes a first arm extending from said first rib and a second arm extending from said second rib, said first and second arms are disposed relative to said remote end of said latch to limit the deflection of said deflectable portion relative to the outer surface of said connector housing.

12. An electrical connector as in claim 11 wherein said first and second arms are interconnected by an anti-overstress bar.

13. An electrical connector comprising a connector housing having an outer surface, a resilient deflectable latch having a base connected to the outer surface of said housing and having a remote end that is deflectable relative to said outer surface of said connector housing, said latch being cantilevered relative to said outer surface of said housing, at least one rib means extending from the outer surface of said connector housing at a location thereon spaced from the base of said resilient deflectable latch and an arm means extending from said rib means, said rib means being disposed relative to said remote end of said latch to inhibit entry of extraneous materials intermediate said remote end of said latch and said outer surface of said connector housing and said arm means being disposed relative to said remote end to limit the deflection of said remote end of said latch relative to said outer surface of said connector housing.

14. An electrical connector as in claim 13 wherein said rib means extends generally perpendicularly from said outer surface of said connector housing and said arm means extends generally transversely from said rib means.

15. An electrical connector as in claim 13 including a pair of rib means, each of said rib means including a rib, said ribs extending from said outer surface of said connector housing on generally opposite sides of said latch and at locations adjacent said remote end of said latch and further including a pair of arm means, each of said arm means including an arm extending from one of said ribs.

16. An electrical connector as in claim 15 wherein each of said pair of ribs extend generally perpendicularly from said outer surface of said connector housing and each of said arms extends generally transversely from the rib from which it extends.

17. An electrical connector as in claim 15 wherein said arms on said ribs are interconnected to form an anti-overstress bar extending between the ribs.

18. An electrical connector as in claim 17 wherein said anti-overstress bar is unitary with said latch and said remote end of said deflectable latch is disposed intermediate said anti-overstress bar and said outer surface of said housing, such that said remote end of said latch is deflectable relative to said anti-overstress bar.

19. An electrical connector as in claim 18 further comprising a pair of side walls extending along said outer surface of said connector housing from said ribs in spaced relationship to said latch and disposed generally on opposite sides thereof, said pair of side walls further inhibiting extraneous materials from entering the space between said latch and said outer surface of said connector housing.

20. An electrical connector as in claim 17 wherein said anti-overstress bar is disposed in spaced relationship to said remote end of said latch when said latch is in an undeflected position such that said latch is deflectable relative to said anti-overstress bar.

21. An electrical connector as in claim 20 further comprising side walls extending from each of said ribs along said outer surface of said connector housing and disposed in spaced relationship to said latch on opposite sides thereof, said side walls further inhibiting extraneous materials from being disposed intermediate said latch and said outer surface of said connector housing.

22. An electrical connector as in claim 13 further comprising a locking protrusion on said latch at a location spaced from the base of said latch.

23. An electrical connector as in claim 13 wherein said remote end of said latch is disposed intermediate said arm means and said outer surface of said connector housing, such that said remote end of said latch is deflectable relative to said arm means.

24. An electrical connector as in claim 23 wherein said latch, said rib means and said arm means are unitarily molded from a plastic material.

25. An electrical connector comprising a housing having at least one external surface; a latch means disposed on said external surface of said housing, said latch means having a resilient deflectable latch portion with a base portion on said external surface, said resilient deflectable latch portion being cantilevered relative to said external surface whereby said deflectable portion is deflectable relative to said external surface, and a locking structure disposed on said deflectable portion of said latch portion; a rib means extending from said external surface and being disposed with respect to an end of said deflectable portion of said latch portion remote from said base portion for inhibiting extraneous materials from becoming so disposed that the material would interfere with the deflection of said deflectable portion; an arm means for limiting deflection of said deflectable portion relative to said external surface of said housing; said latch means, rib means and arm means being unitarily molded from a plastic material; and said latch portion of said latch means being disposed intermediate said arm means and said external surface of said housing, such that said latch portion is deflectable relative to said arm means.

26. An electrical connector as in claim 25 wherein said rib means includes a pair of ribs and said arm means includes a pair of arms, one of said arms extending from one of said ribs, said arms being unitarily interconnected by an anti-overstress bar.

* * * * *